United States Patent [19]

Clarke

[11] Patent Number: 4,669,731

[45] Date of Patent: Jun. 2, 1987

[54] SLOT MACHINE WHICH PAYS OUT UPON PREDETERMINED NUMBER OF CONSECUTIVE LOST GAMES

[75] Inventor: George Clarke, Hornsby, Australia

[73] Assignee: Kabushiki Kaisha Universal, Oyama, Japan

[21] Appl. No.: 818,987

[22] Filed: Jan. 8, 1986

[30] Foreign Application Priority Data

Jan. 11, 1985 [JP] Japan ..... 60-1450[U]

[51] Int. Cl.[4] ..... G07F 17/34

[52] U.S. Cl. ..... 273/143 R; 194/217; 377/5; 377/7; 364/412; 273/138 A

[58] Field of Search ..... 273/138 A, 143 R; 194/218, 219, 239, 240, 241, 242, 243, 244, 245, 246, 215, 216, 217, 353; 377/5, 7; 364/410, 412

[56] References Cited

U.S. PATENT DOCUMENTS

| | | | |
|---|---|---|---|
| 2,071,600 | 2/1937 | Wellekens | 377/5 X |
| 2,368,874 | 2/1945 | Poole | 377/5 X |
| 3,269,503 | 8/1966 | Foster | 273/143 R X |
| 3,852,576 | 12/1974 | Rudd | 273/1 E X |
| 4,213,524 | 7/1980 | Miyashita et al. | 194/242 X |
| 4,225,030 | 9/1980 | Kilman, Jr. | 377/7 X |
| 4,442,850 | 4/1984 | Austin et al. | 133/8 R X |
| 4,492,379 | 1/1985 | Okada | 273/143 R |

FOREIGN PATENT DOCUMENTS

| | | | |
|---|---|---|---|
| 0082706 | 6/1983 | European Pat. Off. | 273/143 R |
| 3220395 | 12/1983 | Fed. Rep. of Germany | 273/143 R |

*Primary Examiner*—Joseph J. Rolla
*Assistant Examiner*—Edward S. Ammeen
*Attorney, Agent, or Firm*—Young & Thompson

[57] ABSTRACT

A slot machine of the type having a plurality of rotatable reels, each bearing an annular row of various symbols on the outer surface thereof, or a corresponding CRT display, which selects and displays combinations of symbols during each game, and which pays out coins not only when predetermined prize-winning combinations of symbols occur on prize-winning rows but also when a predetermined number of consecutive lost games take place.

11 Claims, 2 Drawing Figures

SLOT MACHINE WHICH PAYS OUT UPON PREDETERMINED NUMBER OF CONSECUTIVE LOST GAMES

BACKGROUND OF THE INVENTION

The present invention relates to slot machines which can pay out coins when a predetermined number of consecutive lost games take place.

As is well known in this art, slot machines have a plurality of rotatable reels each of which is provided with an annular row of various symbols thereon. During a game, each reel is caused to rotate, and is stopped at one of the possible stop positions in each of which it displays a corresponding symbol to a player through a window. When all the reels stop, a win decision is made based on the combination of symbols stopping on the winning line or lines.

In these slot machines, the probability of the occurrence of winning combinations of symbols generally depends on the numbers of different kinds of symbols, the numbers of symbols on each reel, and the numbers of reels. For economic reasons, such slot machines keep the probability of the occurrence of winning combinations of symbols relatively low. As a result, the slot machine gives reduced chances of winning to average players, compared to skilled players who can discriminate, to some degree, symbols from each other on a rotating reel. This causes average players to lose their interest in playing games because too many consecutive lost games will be apt to take place.

This problem of consecutive lost games is common to slot machines of the type which use a simulated video display of rotating reels on a CRT screen as well as to slot machines of the type having mechanical rotatable reels.

OBJECT OF THE INVENTION

A principal object of the present invention is, therefore, to provide a slot machine which is adapted to pay out coins when consecutive lost games take place.

Another object of the present invention is the provision of a slot machine in which the number of consecutive lost games taking place is shown to the player.

A further object of the present invention is the provision of a slot machine which is adapted to pay out as many coins as the number of coins spent for consecutive lost games.

A still further object of the present invention is the provision of a slot machine in which the number of coins spent for consecutive lost games is shown to the player.

SUMMARY OF THE INVENTION

For achieving the above-mentioned object, the slot machine in accordance with the present invention comprises a game counter for counting up lost games in which there is no occurrence of a prize-winning combination of symbols, means for resetting the game counter to its initial value, usually zero (0), when there is a prize-winning combination of symbols in any game, means for paying out coins of the number corresponding to prize-winning combinations of symbols that have occurred in a game, and means for actuating the coin pay-out means when a predetermined number of consecutive lost games take place, so as to pay back coins spent for the lost games. The distinctive feature of the slot machine in accordance with the present invention lies in the fact that the game counter includes an indicator for visibly showing the counted value to the player.

Thus in the event of consecutive lost games, the player can play games with a special interest even though there is no occurrence of a prize-winning combination of symbols in a game. In addition, when a predetermined number of consecutive lost games take place, the player can get the feeling of satisfaction of getting a special prize, which is different in kind from that of winning games.

BRIEF DESCRIPTION OF THE DRAWINGS

The above-mentioned and other objects and features of the present invention will be more apparent upon consideration of the following description taken in connection with the accompanying drawings, in which.

DETAILED DESCRIPTION OF THE INVENTION

Figure 1:
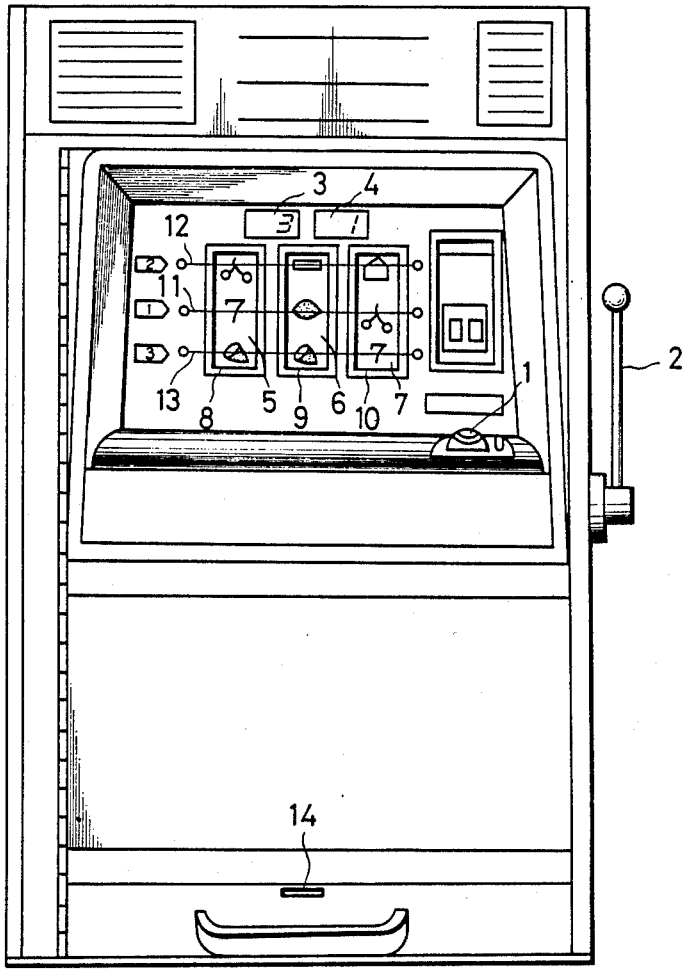
FIG. 1 is a front view showing an embodiment of the slot machine according to the present invention.

FIG. 1 shows an example of a slot machine according to the present invention which includes a set of reels 5 to 7 having symbols on the periphery. The reels 5 to 7 are rotatably arranged side by side. Through reel windows 8 to 10, three symbols on each reel 5 to 7 can be observed when the reel stops; however, this is almost impossible while the reel is moving.

The slot machine is played by the insertion of coins into a coin slot 1 and pulling a start lever 2. When the player pulls the start lever 2, stepping motors 28 to 30 (shown in FIG. 2) start into rotation so as to rotate the respective reels 5 to 7 simultaneously. After each reel 5 to 7 reaches a constant speed of rotation, each reel 5 to 7 is controlled to stop on a random basis. When each reel is thus randomly stopped, the displayed symbols on each reel 5 to 7 may be observed through respective reel windows 8 to 10.

A winning line 11 is provided for use in common with all the reel windows 8 to 10. When all the reels 5 to 7 stop as described above, a win decision is made based on the combination of symbols stopping on the winning line 11. In addition to the winning line 11, it is possible to provide other winning lines 12 and 13 as shown in FIG. 1. In this way, it is possible to increase the number of effective winning lines in accordance with the number of coins inserted prior to the start of a game. Therefore, the increased number of coins inserted into the slot machine increases the probability of obtaining a win. The number of coins inserted prior to a game is indicated by a digital coin indicator 3.

As a result of the win decision, if in fact there is a win, as many coins as the number corresponding to the kind of that win are paid out from a pay-out outlet 14. At the same time, the coin indicator 3 is reset to zero (0), and the game comes to an end.

On the other hand, as a result of the win decision, in the event that the game comes to an end without any winning combination of symbols occurring on any winning line, the coin indicator 3 maintains its indication unchanged while a game indicator 4 indicates a number increased by one which means the number of lost games.

While the player is consecutively losing games, the number of coins spent for each lost game is added to the total number of coins spent for previous consecutive lost games; the resulting total number of coins is indicated in the coin indicator 3 as well as the number of consecutive lost games in the game indicator 4 at the end of every lost game. In the event that a predetermined number of, for example thirteen, lost games consecutively take place, the slot machine pays out as many coins as the number corresponding to the number indicated in the coin indicator 3, namely, the number of coins spent for the thirteen consecutive lost games.

However, at any time when the player gets a win in a game before thirteen consecutive lost games, the coin and game indicators 3, 4 are rest to zero (0) at once.

Figure 2:
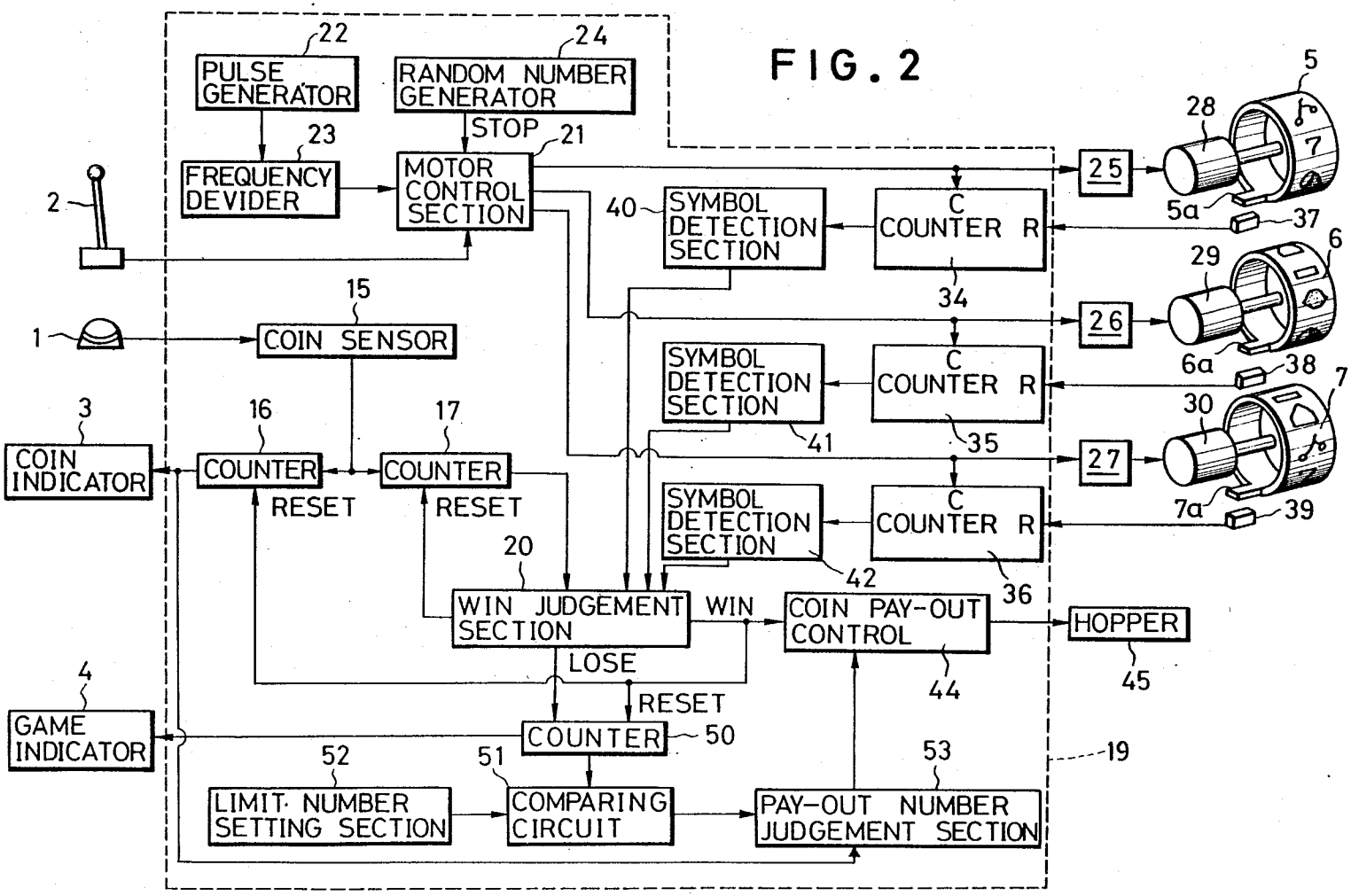
FIG. 2 is a block diagram showing a game circuit applied to the slot machine of FIG. 1.

The above is performed under the control of a system including a microcomputer 19 enclosed by a phantom line in FIG. 2. In FIG. 2, prior to the start of a game, coins are inserted into the slot machine through the coin slot 1 and detected by a coin sensor 15 which outputs a pulse for each coin. The pulses are counted by pulse counters 16 and 17. The number of pulses counted by the counter 16 is indicated by the coin indicator 3.

Upon pulling the start lever 2 mounted on the side of the slot machine, the motor control section 21 is actuated, and in turn derive pulses generated by the pulse generator 22 are, after being modulated to a specified frequency by means of a frequency divider 23, supplied through the motor control section 21 to motor drive sections 25 to 27, thereby driving stepping motors 28 to 30. As a result, each reel 5 to 7 rotates and a game starts. The drive pulses for driving the respective stepping motors 28 to 30 are on the other hand cumulatively counted by respective counters 34 to 36 provided for each reel. The cumulative count value of the drive pulses is utilized in identifying the symbols on each reel as will be described later. To this end, it is necessary to reset to zero the respective counters 34 to 36 every one revolution of a reel. The reset pulse for this purpose is obtained by detecting light interception lugs 5*a* to 7*a* mounted on each reel 5 to 7 by means of photointerrupters 37 to 39.

It should be noted that the numbers of pulses counted by each counter 34 to 36 have a precise relation to the respective symbols arranged on each reel associated with the counter. Thus, it can be detected based on the counted value of the counter which symbols are displayed on the winning lines.

When each reel 5 to 7 reaches a constant speed of rotation, a random number generator 24 creates random numbers and causes the motor control section 21 to terminate the drive pulses supplied thereto from the pulse generator 22 so as to stop the stepping motors sequentially at positions corresponding to the random numbers supplied to the motor control section 21.

After all the reels 5 to 7 stop, symbols for respective reels stopping on the winning lines are identified by symbol detection sections 40 to 42 with reference to the counted value of the drive pulses in the pulse counters 34 to 36. The symbols for respective reels which are transformed into a code signal comprised by a certain number of pulses are judged by a win judgment section 20 as to whether the three symbols of the reels on the winning line correspond to any one of winning combinations of symbols; and if it is a win, the number of coins to be paid is determined according to the winning combination of symbols that has occurred. These decisions are performed with reference to a winning table (for example, a ROM memory is used) included in the win judgment section 20. If in fact a win occurs, an appropriate number of coins are paid out by a coin pay-out control 44 into a hopper 45. It should be understood that these decisions are made for each winning line.

The win judgment section 20 resets to zero the counter 16 and another counter 50 which will be described later if a win occurs, and resets the counter 17 regardless of the occurrence of a win.

On the other hand, the win judgment section 20 causes the counter 50 to count up by one every decision that a consecutive lost game has taken place, while leaving the counter 16 to count up used coins. Each counted value can be indicated in the digital indicators 3 and 4.

The counted value in the counter 50 is then compared with the number of games, for example thirteen games, set in a limit number setting section 52 by means of comparison circuit 51. When the counted value reaches the prescribed limit number, the comparison circuit 51 causes a pay-out number judgment section 53 to allow a coin pay-out control 44 to cause a coin hopper 45 to pay out as many coins as the number corresponding to the value counted by the counter 16. That is, when thirteen consecutive games are lost, the whole number of coins having been spent for the lost games are paid out. Such a special coin pay-out can be considered either as the compensation of the player who is consecutively losing games, or as itself a type of win. In view of the above consideration, it may be attractive to pay out a part of or more than the whole number of coins spent for the predetermined number of consecutive lost games.

It is apparent that when there is a win before a predetermined number of consecutive lost games take place, both of the counters 16 and 50 are reset to zero and then restart to count up games and coins after the occurrence of a win in the same way as described above.

Although the foregoing description of the present invention has been made with reference to a slot machine of the type which is adapted to receive coins inserted thereinto prior to the play of every game, the present invention is applicable with the same result to slot machines of the credit type which is adapted to allow inserting a larger number of coins thereinto instead of inserting coins prior to the play of every game, to deduct a certain number of coins from the remaining coins every game and when there is a win, to add the number of coins to be paid out corresponding to the win into the remaining number of coins, so as to indicate the total creditable number of coins which can be paid out at any time when the play is through by pushing an end button. Furthermore, the limit number setting section 52 and pay-out number judgment section 53 are easily adapted to set different numbers or pay-out rates. This makes the slot machine vary the pay-out rate, namely, the ratio of the number of coins to be paid out to the whole number of coins spent for games, which has been difficult in slot machines heretofore marketed.

The present invention being thus described, it will be obvious that the same may be varied in many ways. Such variations are not to be regarded as a departure from the spirit and scope of the invention, and all such modifications are intended to be included within the scope of the following claims.

What is claimed is:

1. A slot machine in which a plurality of lengthwise movable series of symbols are started to move after the insertion of coins thereinto and stopped to select combinations of symbols on predetermined prize-winning lines in the play of a game, said slot machine comprising:

a game counter for counting up every lost game in which there is no occurrence of a prize-winning combination of symbols;

means for resetting said game counter to its initial value when there is a prize-winning combination of symbols in any game;

means for paying out coins in a number corresponding to prize-winning combinations of symbols that have occurred in a game; and means for actuating said coin pay-out means when the counted value of said lost game counter reaches a predetermined number, so as to pay out a certain number of coins when consecutive lost games of said predetermined number take place.

2. A slot machine as defined in claim 1, further comprising a game indicator for showing the counted value of said lost game counter.

3. A slot machine as defined in claim 1, further comprising a coin counter for counting up coins spent for lost games, said coin pay-out means paying out coins of the number corresponding to the counted value of said coin counter when consecutive lost games of said predetermined number take place.

4. A slot machine as defined in claim 3, wherein said coin counter is reset to its initial value when there is a prize-winning combination of symbols.

5. A slot machine as defined in claim 4, further comprising a coin indicator for showing the counted value of said coin counter.

6. A slot machine as defined in claim 5, further comprising means for changing said predetermined number.

7. A slot machine as defined in claim 2, further comprising a coin counter for counting up coins spent for lost games, said coin pay-out means paying out coins of the number corresponding to the counted value of said coin counter when consecutive lost games of said predetermined number take place.

8. A slot machine as defined in claim 7, wherein said coin counter is reset to its initial value when there is a prize-winning combination of symbols.

9. A slot machine as defined in claim 8, further comprising a coin indicator for showing the counted value of said coin counter.

10. A slot machine as defined in claim 9, further comprising means for changing said predetermined number.

11. A slot machine as defined in claim 1, further comprising means for changing said predetermined number.

* * * * *